United States Patent [19]

Weisfeld

[11] Patent Number: 4,890,401

[45] Date of Patent: Jan. 2, 1990

[54] SHIRT PRESSING APPARATUS EMPLOYING COOPERATIVE PLATENS

[76] Inventor: David Weisfeld, 81 Wood Vale, London, England, N10 3DL

[21] Appl. No.: 218,903

[22] Filed: Jul. 14, 1988

[30] Foreign Application Priority Data

Jul. 15, 1987 [GB] United Kingdom ..... 8716719

[51] Int. Cl.[4] ..... D06F 71/06; D06F 71/22

[52] U.S. Cl. ..... 38/43; 38/66; 38/71; 38/110; 223/37; 223/52.1

[58] Field of Search ..... 223/37, 52.1, 52.3, 223/57; 38/43, 66, 71, 110, 111; 29/121.2

[56] References Cited

U.S. PATENT DOCUMENTS

| | | | |
|---|---|---|---|
| 2,126,618 | 8/1938 | Chevalier | 223/37 |
| 2,246,251 | 6/1941 | Hanney | 223/57 |
| 4,026,444 | 5/1977 | Harjapaa | 223/37 |
| 4,110,152 | 8/1978 | Dunning et al. | 29/121.2 X |
| 4,689,905 | 9/1987 | Vartan | 38/26 |

*Primary Examiner*—Andrew M. Falik

*Attorney, Agent, or Firm*—Larson and Taylor

[57] ABSTRACT

Apparatus for pressing shirts comprising an upper platen provided with a cut-out and a lower platen, between which a shirt is pressed. Nozzles permit moisture to be sprayed on the front of the shirt prior to pressing. An ejector rod enables a pressed shirt to be removed from the lower platen after pressing. A rod slidably secured to a casing allows the shirt to be correctly located on the lower platen by engaging with the neck apex of the shirt. An adjustment knob varies the distance between the upper and lower platens to ensure that the fabric of the shirt is not crushed during the pressing operation. Various controls are provided to adjust parameters affecting the pressing operation. In a modified form the lower platen may be duplicated in a carousel or sliding tray arrangement.

9 Claims, 3 Drawing Sheets

SHIRT PRESSING APPARATUS EMPLOYING COOPERATIVE PLATENS

FIELD OF THE INVENTION

The present invention relates to apparatus for pressing shirts and other garments where a particular area of the garment such as the collar must not be pressed flat and/or where the pressing process may be a finishing process, carried out after the shirt is folded.

DESCRIPTION OF THE PRIOR ART

According to generally known methods, pressing of shirts may be carried out by either applying heat and/or steam to the fabric through a platen urged by mechanical or other means against the fabric to be pressed and or, by the use of a hand held heated iron which is pressed by hand over the fabric and which may also be set-up, to apply steam to the fabric.

The former means can be utilized for the body of the shirt but not for the collar and surrounding areas, as the collar must not be pressed flat.

In the latter means, an iron can be used to press the shirt around the collar but the process is time consuming and there is no standard finish since each operator will use the hand iron in a different manner.

One known apparatus for folding and pressing garments, and in particular shirts is disclosed in U.S. Pat. No. 4,026,444. The apparatus includes a heated base plate for supporting the shirt on its front, a holding plate hingedly attached to the collar end of the base plate, a center plate arranged at the tail end of the base plate and adapted to be moved above and over the base plate, a stripper plate hingedly attached to the tail end of the center plate, and side plates arranged at different levels above and along the sides of the base plate and center plate and adapted to fold the side portions of the shirt over the center portion thereof. A collar expander is provided, the collar of the shirt being placed therearound, the base plate being provided with a cut away section in the vicinity of the collar expander in order to ensure that the collar is not pressed.

The mechanism disclosed in the above numbered U.S. patent is essentially a shirt folding machine. It is extremely complex and requires the operator to set the various side and center plates correctly before the folding operation can commence. Furthermore, the amount of pressing is minimal and only the base plate is heated.

SUMMARY OF THE INVENTION

It is an object of the present invention to overcome the above disadvantages of the known mechanisms, particularly that disclosed in U.S. Pat. No. 4,026,444, thus providing a pressing apparatus which will turn out a smartly pressed shirt ready for packaging and/or display, on a separate apparatus to the folding apparatus.

According to the present invention there is provided apparatus for pressing shirts including:

(a) upper and lower platens;

(b) means for heating at least one of said platens;

(c) a cut-out provided in the upper platen to provide a space for the collar of the shirt to be pressed;

(d) heat resistant resilient material attached to the pressing surface of at least one of the platens;

(e) means for urging said platens together to press a shirt located therebetween.

Preferably, both upper and lower platens are heated. The temperature to which the platens are heated may be controlled by means of adjustable thermostat. The duration of a pressing operation may also be controlled by an adjustable timer mechanism.

The upper platen may be provided with a first wide shallow groove to act as a recess for the placket of the shirt, and at least one second narrow shallow groove located centrally within said first groove to act as a recess for the buttons of the shirt.

Furthermore, the upper platen may be provided with an approximately square recessed portion at one corner thereof to act as a recess for a cuff of the shirt.

In order to adjust for different types of collars, a plurality of sets of plate means may be provided for securing to the sides of the upper platen defining the cut-out portion.

Nozzle means may be provided for the purpose of spraying the shirt to be pressed with moisture prior to a pressing operation. The pressure of the spray and the duration thereof may also be adjustable.

A positioning device may be provided to assist in locating a shirt in the correct position on the lower platen. Such a positioning device may take the form of a rod secured to the casing of the apparatus.

An additional heated platen and/or collar expander may be secured to the upper platen for the purpose of pressing the exposed back of the shirt inside the collar.

An ejector rod may be provided to eject the shirt from the lower platen once the pressing operation has been completed.

BRIEF DESCRIPTION OF THE DRAWINGS

The present invention will now be described in greater detail by way of examples with reference to the accompanying drawings, wherein.

DESCRIPTION OF THE PREFERRED EMBODIMENTS

Figure 1:
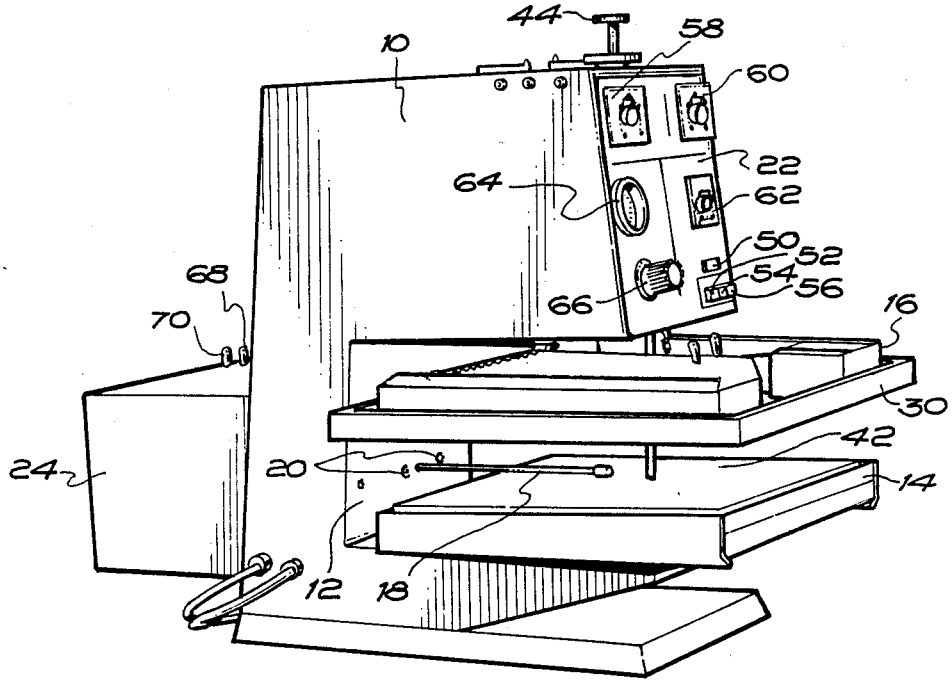
FIG. 1 is a perspective view of a preferred form of apparatus for pressing shirts.

Referring first to FIG. 1, the apparatus for pressing shirts together with all its associated equipment is housed within a casing 10. Located within a recess 12 of the casing 10 are a lower fixed platen 14 and an upper movable platen 16.

At the back of the recess 12 and projecting from the casing 10 is a pusher rod 18 and a pair of nozzles 20, the rod being operated to eject a pressed shirt from the lower platen 14 once the upper platen 16 has been raised on completion of the pressing operation. The actuation of the pusher rod 18 is achieved by means of a conventional mechanical linkage (not shown) connected to a conventional pneumatically controlled mechanism (not shown) so that the pusher rod 18 is extended when the upper platen 16 is raised and retracted when it is lowered. The nozzles 20 are provided for spraying moisture, i.e. deionized water onto the front of the folded shirt before the upper platen 16 descends to commence the pressing operation.

The casing 10 also contains a control panel 22 on the upper front face thereof on which a number of controls are located. These various controls will be described later on. An auxiliary casing 24 located behind or on the rear face of the main casing 10 houses the equipment for supplying the water spray and also the pusher rod actuating mechanism.

Figure 2:
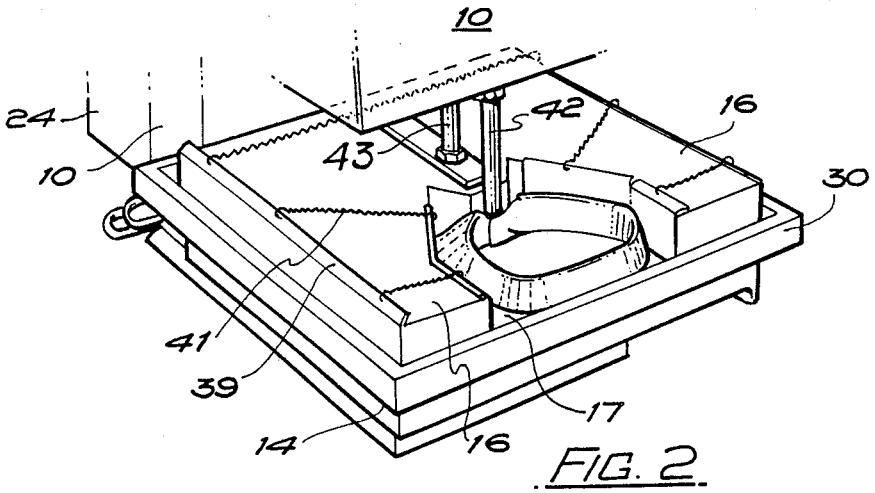
FIG. 2 is a perspective view of the platens with a shirt in the pressing position.
Figure 3:
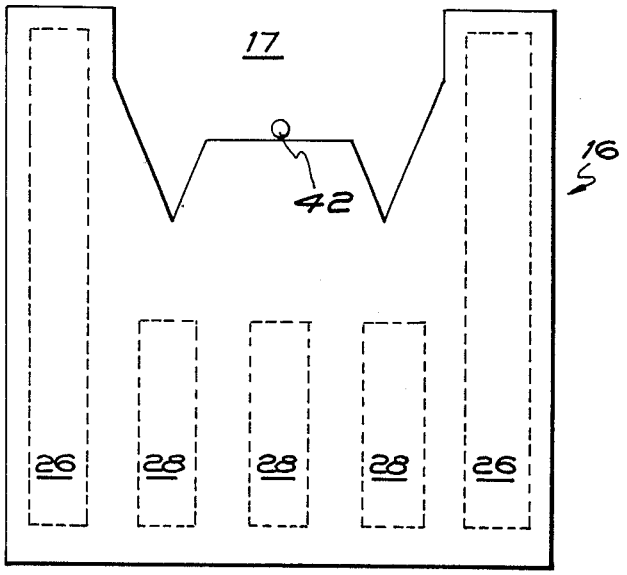
FIG. 3 is a plan view of the top surface of the upper platen.

The upper platen 16 is shown in greater detail in FIGS. 2 and 3. It is approximately square, having a cut-out portion 17 through which the collar of the shirt can project as shown in FIG. 2. It is provided with internally fitted heating strips a pair of strips 26 along the sides and three shorter strips 28 in the central zone away from the cut-out portion 17. It is also provided with a guard rail 30 which totally surrounds it including the cut-out portion 17, which is designed to prevent the operator accidentally trapping his fingers.

Movement of the upper platen 16 vertically in relation to the lower platen 14 is achieved by the aforementioned conventional pneumatically controlled mechanism (not shown). A pair of rods 43, only one of which is shown in FIG. 2, connects the upper platen 16 to this pneumatically controlled mechanism which is housed in the upper part of the casing 10.

Figure 4:
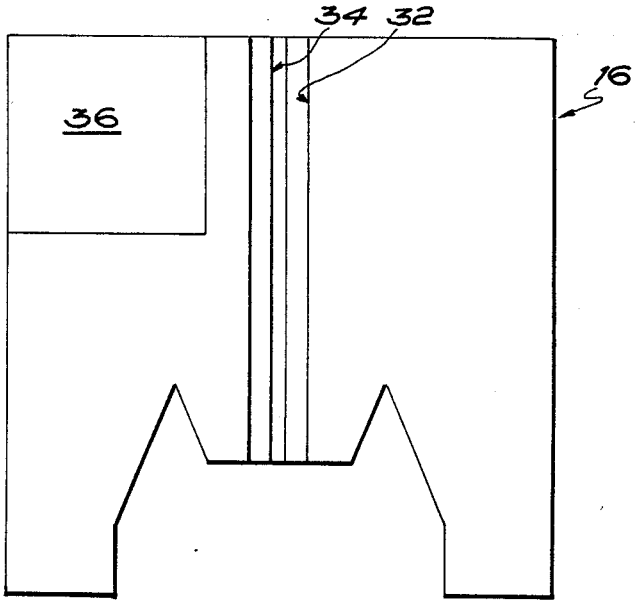
FIG. 4 is a plan view of the underneath pressing surface of the upper platen.

The underneath surface of the upper platen 16 is shown in greater detail in FIG. 4. In its central zone it is provided with two longitudinal extending shallow grooves. A first wide shallow groove 32 is provided to act as a recess for the placket of the shirt and a second narrow shallow groove 34 centrally located within the first groove is provided as a recess for the buttons of the shirt. At one corner of the upper platen 16 is an approximately square recessed portion 36 which is provided as a recess for a cuff of the shirt which is folded such that the cuff can be displayed for tho purchaser to view when the shirt is packaged.

The lower platen 14 is also approximately square and of the same size as the upper platen 16. It is likewise provided with internally fitted heating strips which extend the length thereof.

Both the upper and lower platens are made of well machined metal. A layer of silicon or similar heat resistant material may be applied to the pressing surfaces of the upper and lower platens in order to provide a resilient heat resistant surface. Additionally a layer of "Teflon" (Registered Trade Mark) coated fiber glass or similar heat resistant material, may be secured to the silicon rubber layer by a suitable adhesive, or by strapping using hooked springs 41 (FIG. 2) or similar retaining means.

Figure 8:
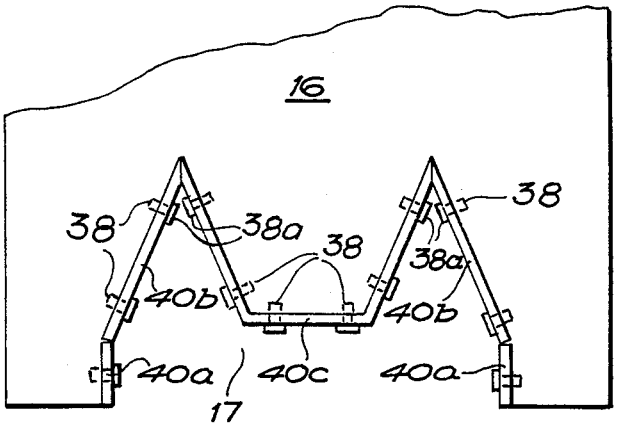
FIG. 8 is a diagrammatically enlarged view of the cut away portion in upper platen showing how its shape and size can be varied to suit different types of collars.

In order to be able to adjust the cut away portion to different shapes and sizes of collars, the sides of the upper platen 16 which define the cut-out portion 17 are provided with a plurality of tapped bolt holes 38 adapted to receive bolts 38*a*, as shown in FIG. 8, in order to attach a plurality of plates. This is shown diagrammatically in FIG. 8 where pairs of straight plates 40*a* and 40*b*, together with a trapezoidal shaped plate 40*c*, surround the collar area of the platen. The plates may be provided in a plurality of sets of different thicknesses so that the cut-out portion 17 can be readily shaped to suit a particular type of collar.

In order to ensure that a shirt can be correctly positioned on the lower platen 14 so that when the upper platen 16 is lowered thereonto for the purpose of pressing the shirt, a rod 42 is secured to the casing 10 and projects downwards towards the pressing surface of the lower platen 14. The lower end of the rod 42 is of such a height above the pressing surface of the lower platen that when the shirt is slid into position the folded material of the shirt passes thereunder but the rod engages against the neck apex of the collar thus ensuring that the collar of the shirt is centralized with respect to the cut away portion of the upper platen. The position of the rod 42 in relation to the upper platen 16 is shown in FIG. 3.

In order to adjust the distance between upper and lower platens when in the pressing position to allow different thicknesses of shirt material, an adjustment knob 44 is provided on the top of the casing 10. The adjustment knob 44 effectively alters the stroke of the aforesaid pneumatically controlled mechanism (not shown) so that the lower or pressing position of the upper platen 16 in relation to the lower platen 14, i.e., the gap therebetween, can be varied within limits. By adjusting the gap between the platens when in the pressing position, it is possible to press shirts whose material is of different thicknesses without causing the fabric being damaged or crushed by excessive pressure.

Referring back again to FIG. 1, the control panel 22 is provided with the following controls:

(a) an electric mains on/off switch 50;
(b) a green start button 52 and a red stop button 54;
(c) an orange on/off switch 56 for the moisture applied to the front of the shirt via the nozzles 20;
(d) temperature controls 58 and 60 for the heat supplied to the upper and lower platens respectively;
(e) a pressure control 62 for setting the time that the upper platen is lowered onto the lower platen for the pressing operation;
(f) a pressure regulator 64 for varying the actual pressure applied to the shirt during the pressing operation; and
(g) a pressure gauge 66 which indicates the actual pressure applied.

In addition the auxiliary casing 24 is provided with following controls:

(h) a timer 68 for adjusting the time of application of the spray; and
(i) a pressure control 70 for adjusting the pressure at which the spray is applied through the nozzles 20.

It will be appreciated that the various switches and controls specified above are standard items of equipment. As is evident from the foregoing, switches 50 and 56 can be standard two-position push button switches, i.e., they have two states, either on or off. Buttons 52 and 54 are conventional single acting switches provided to respectively start the pressing operation and stop the operation in an emergency by appropriate control of the aforementioned pneumatically controlled mechanism (not shown). The temperature control knobs 58 and 60 each have an associated pointer which rotates with respect to a scale, and, in a conventional manner, when rotated, vary the amount of resistance connected in the control circuit for the heating strips (e.g., strips 26, 28) so as to control of the quantity of electric current supplied to the heating strips in the upper and lower platens. The pressure control knob 62 is associated with a timer (not shown) which actuates the pneumatically controlled mechanism so as to raise the upper platen 16 at the end of a preset adjustable pressing operation. The pressure regulator 64 controls the pressure of the air in the aforementioned pneumatically controlled mechanism (not shown) and thus the pressure applied to a shirt during a pressing operation. The timer 68 and pressure control 70 are, as illustrated, small knobs located at the top of the auxiliary casing and are used to adjust a pneumatically controlled mechanism (not shown) to provide for adjustment in the duration and pressure of the spray applied through the nozzles 20. Again, these controls are all standard items of equipment.

The operation of the above described shirt pressing machine will now be described in greater detail.

In the inoperative position the upper platen 16 is raised and the pusher rod 18 is fully withdrawn into the casing 10. The shirt locating rod 42 extends downwards to a short distance above the lower platen 14. The mains on/off switch 50 is switched to "on" and a folded shirt is slid along the top of the lower platen 14 until the neck apex of the shirt comes to rest against the end of the rod 42.

Next the various controls are set and/or adjusted to the desired requirements of pressing. If a moisture spray is required, the orange switch 56 is moved to "on" and the spray timing and pressure controls 68 and 70 set as required. Also the desired time and pressure for pressing by means of the upper platen are set on the controls 62 and 66, and the required temperature to which the two platens are to be heated are set by means of the temperature control 58 and 60.

When all these operations have been completed the green start button 52 is pressed. If the moisture spray switch 56 is in the "on" position, the water spray unit housed in the auxiliary casing 24 is energized, and moisture at the desired pressure and for the desired duration as set by the controls 68 and 70 is sprayed onto the whole of the upper surface of the shirt by means of the nozzles 20.

When the spraying operation has been completed the main pneumatically operated mechanism forces the upper platen 16 down on top of the shirt and the pressing operation commences as shown in FIG. 2. Both platens are heated to the desired temperature as set by the respective temperature controls 58 and 60, and the desired pressure maintained for the desired time as set by the respective controls 66 and 62.

At the end of the preset time the pneumatically controlled mechanism raises the upper platen 16 and the push rod 18 is actuated to eject the shirt from the lower platen 14. It should be noted that it would be possible to arrange for the shirt to be ejected straight into a packaging machine to wrap the shirt for the purposes of display.

The machine is then ready for the next shirt to be pressed. If at any point during the pressing operation it is desired to abort the operation, the red stop button 54 is pressed. Operation of this button de-energizes the pneumatic system and the upper platen 16 is automatically returned to its raised position as shown in FIG. 1, and the shirt pressing apparatus will not restart again until the green button 52 is pressed.

It should be noted that the shirt locating rod 42 is spring biased and remains substantially stationary as the upper platen 16 is lowered and raised, thus does not damage the shirt and moreover is in the correct position to locate another shirt as soon as the upper platen 16 has been raised.

Various modifications to the above described shirt pressing apparatus are possible. Instead of providing the pusher rod 18 to eject the pressed shirts, one may use either a carousel tray arrangement or a sliding tray arrangement. This effectively means that two lower platens are provided which alternate with one another during the pressing operation, so that the next shirt can be loaded while a first shirt is being pressed. In such modification the locating rod 42 would be omitted.

Figure 5:
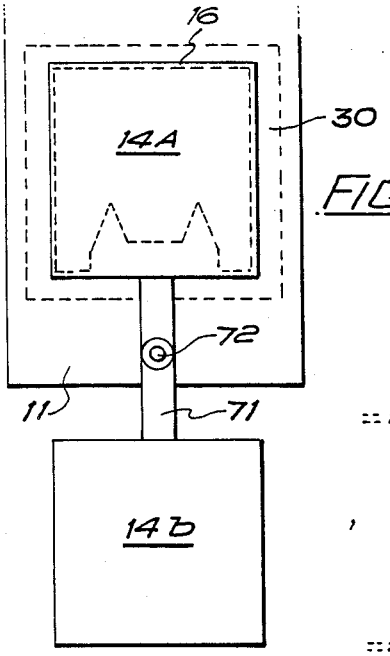
FIG. 5 is a plan view of a first modified form of pressing apparatus provided with a carousel feeding system.

Referring first to FIG. 5, the carousel arrangement comprises two loading trays **14*a* and 14*b* joined by a bar 71 which is rotatable about a vertical shaft 72 extending upwards from an extended base 11 of the casing 10. Each loading tray consists of a square frame which is covered by flexible heat resistant material, e.g. Teflon. Thus, while a shirt on one tray 14*a* is being pressed between the lower platen 14 and the upper platen 16, the other tray 14*b* is outside the pressing apparatus at a convenient position for an operator to remove a previously pressed shirt and replace it by another to be pressed. The carousel may be either rotated manually at the end of a pressing operation, or electro-pneumatically by the mechanism when the green start button 52** is pressed to start another pressing cycle. Such a carousel arrangement may comprise three trays at 120° or four trays at 90° .

Figure 6:
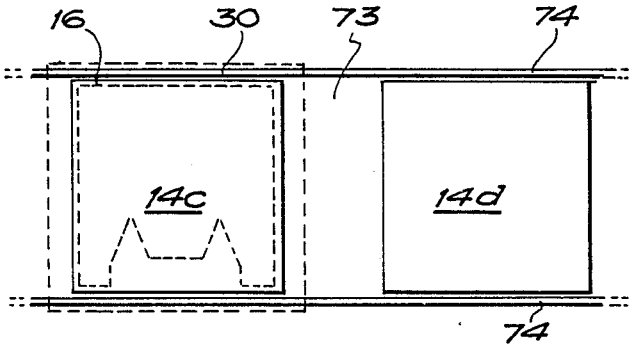
FIG. 6 is a plan view of a second modified form of pressing apparatus provided with a sliding tray feeding system.

Referring now to FIG. 6, the sliding tray arrangement comprises two loading trays **14*c* and 14*d* effectively joined side by side by means of a strip 73 and guided by suitably arranged rails 74 to move horizontally sideways in both directions. Again, each loading tray consists of a square frame which is covered by flexible heat resistant material e.g. Teflon. Thus while a shirt on one tray 14*c* is being pressed between the lower platen 14 and the upper platen 16, the other tray 14*d*** is outside the pressing apparatus at a convenient position for the operator to remove a previously pressed shirt and replace it by another to be pressed. The sliding tray may be either moved manually or electro-pneumatically.

Figure 7:
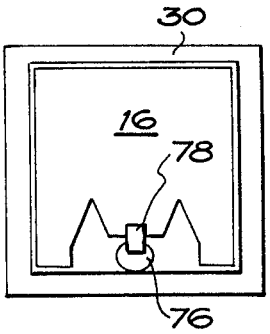
FIG. 7 is a diagrammatic view of a third modified form of pressing apparatus provided with an additional heated platen for pressing the exposed back of the shirt inside the collar.

In yet another modification shown in FIG. 7, an additional heated platen 76 is secured to the upper platen 16 by means of fixing means 78 for the purpose of pressing the exposed back of the shirt inside the collar, i.e. that part of the shirt (excluding the collar) which is visible in FIG. 2. Such an arrangement may also incorporate a collar expander (not shown).

While the above described apparatus together with its modifications have been described in connection with pressing shirts, it may be adapted to press similar types of garments, e.g. blouses and pajamas.

The above described apparatus for pressing shirts together with the various modification proposed is robust in operation, completely safe to operate, and relatively inexpensive to manufacture. Moreover it is capable of providing a neat and highly presentable final product.

What I claim is:

1. Apparatus for pressing shirts including:

(a) upper and lower platens movable into and out of a pressing position for pressing a shirt;

(b) electric means for heating at least one of said platens;

(c) a cut-out in one of said platens to provide a space for the collar of the shirt to be pressed;

(d) heat resistant resilient material attached to the pressing surface of at least one of the platens; and (e) a first wide shallow groove in one of said platens which acts as a recess for the placket of the shirt, at least one second narrow shallow groove located centrally within said first groove which acts as a recess for the buttons of the shirt, and an approximately square recessed portion at one corner of said one platen which acts as a recess for a cuff of the shirt.

2. Apparatus according to claim 1, wherein said upper platen moves in relation to the lower platen, wherein said lower platen is fixed and wherein manually operated controls are provided to vary the duration and pressure of a pressing operation.

3. Apparatus according to claim 2, wherein an additional platen is secured to the upper platen to press the exposed back of the shirt inside the collar.

4. Apparatus according to claim 1, wherein the cut-out is provided in the upper platen and a plurality of sets of plate means are provided for securing to the sides of the upper platen defining the cut-out portion to adjust the size and shape of the cuts-outs according to different types of collars.

5. Apparatus according to claim 4, further comprising a rod-shaped positioning device for assisting in positioning of a shirt on the lower platen prior to the pressing operation, said positioning device extending through the cut-out in the upper platen in order to engage the neck apex of the collar of a shirt to be pressed.

6. Apparatus according to claim 1 further comprising nozzle means for spraying a shirt to be pressed with moisture before the pressing operation commences, and manually operated control means for adjusting the pressure and duration of spray applied by said nozzle means.

7. Apparatus according to claim 1, further comprising a rod for ejecting a shirt from the lower platen when a pressing operation has been completed and the two platens have been moved out of said pressing position.

8. Apparatus according to claim 1, further comprising manually operated control means for adjusting the gap between the upper and lower platens when in said pressing position.

9. Apparatus according to claim 1, further comprising at least two movable loading trays for conveying shirts to be pressed from a loading station to the pressing position, each tray comprising a frame covered with heat resistant material.

* * * * *